US009267744B2

(12) United States Patent
Heitmann et al.

(10) Patent No.: US 9,267,744 B2
(45) Date of Patent: Feb. 23, 2016

(54) GASIFICATION REACTOR WITH A HEAT EXCHANGE UNIT PROVIDED WITH ONE OR MORE FOULING PROTECTION DEVICES

(75) Inventors: Alfons Heitmann, Bergneustadt (DE); Thomas Paul Von Kossak-Glowczewski, Amsterdam (NL); Juergen Kowalow, Hueckeswagen (DE)

(73) Assignee: Shell Oil Company, Houston, TX (US)

( * ) Notice: Subject to any disclaimer, the term of this patent is extended or adjusted under 35 U.S.C. 154(b) by 342 days.

(21) Appl. No.: 13/819,034

(22) PCT Filed: Aug. 26, 2011

(86) PCT No.: PCT/EP2011/064719

§ 371 (c)(1),
(2), (4) Date: Jun. 5, 2013

(87) PCT Pub. No.: WO2012/028550

PCT Pub. Date: Mar. 8, 2012

(65) Prior Publication Data

US 2013/0292087 A1 Nov. 7, 2013

(30) Foreign Application Priority Data

Aug. 30, 2010 (EP) ..... 10174505

(51) Int. Cl.

| | |
|---|---|
| ***B01J 7/00*** | (2006.01) |
| ***F28F 9/007*** | (2006.01) |
| ***C10J 3/76*** | (2006.01) |
| ***F23J 3/02*** | (2006.01) |
| ***F23M 9/06*** | (2006.01) |
| ***F28G 1/16*** | (2006.01) |
| ***C10J 3/48*** | (2006.01) |
| ***C10J 3/86*** | (2006.01) |

(Continued)

(52) U.S. Cl.

CPC ..... *F28F 9/007* (2013.01); *C10J 3/485* (2013.01); *C10J 3/76* (2013.01); *C10J 3/86* (2013.01); *F23J 3/02* (2013.01); *F23M 9/06* (2013.01); *F28G 1/166* (2013.01); *C10J 2200/152* (2013.01); *C10J 2300/1884* (2013.01); *C10J 2300/1892* (2013.01); *F28D 7/1669* (2013.01); *F28D 2021/0075* (2013.01); *F28F 9/013* (2013.01); *F28F 9/0265* (2013.01)

(58) Field of Classification Search

CPC ... C10J 3/485; C10J 3/845; F28D 2021/0075; F28D 7/0041; F28D 7/00; F28D 7/1669; F28D 9/0006

See application file for complete search history.

(56) References Cited

U.S. PATENT DOCUMENTS

| | | | | |
|---|---|---|---|---|
| 4,456,057 | A | 6/1984 | Melcer | 165/95 |
| 4,520,760 | A | 6/1985 | Covell | 122/7 |

(Continued)

FOREIGN PATENT DOCUMENTS

| | | | |
|---|---|---|---|
| EP | 0077729 | 4/1983 | C10J 3/86 |
| EP | 0314929 | 5/1989 | F22B 1/18 |

(Continued)

*Primary Examiner* — Imran Akram

(57) ABSTRACT

A gasification reactor with a heat exchange unit having a gas flow channel and one or more heat exchangers arranged within the gas flow channel, the heat exchangers having one or more heat exchange surfaces and one or more associated structures, such as a support structure or deflector plates. The associated structures are provided with fouling protection devices, such as blasters or flow guiding surfaces.

13 Claims, 7 Drawing Sheets

Figure 1:
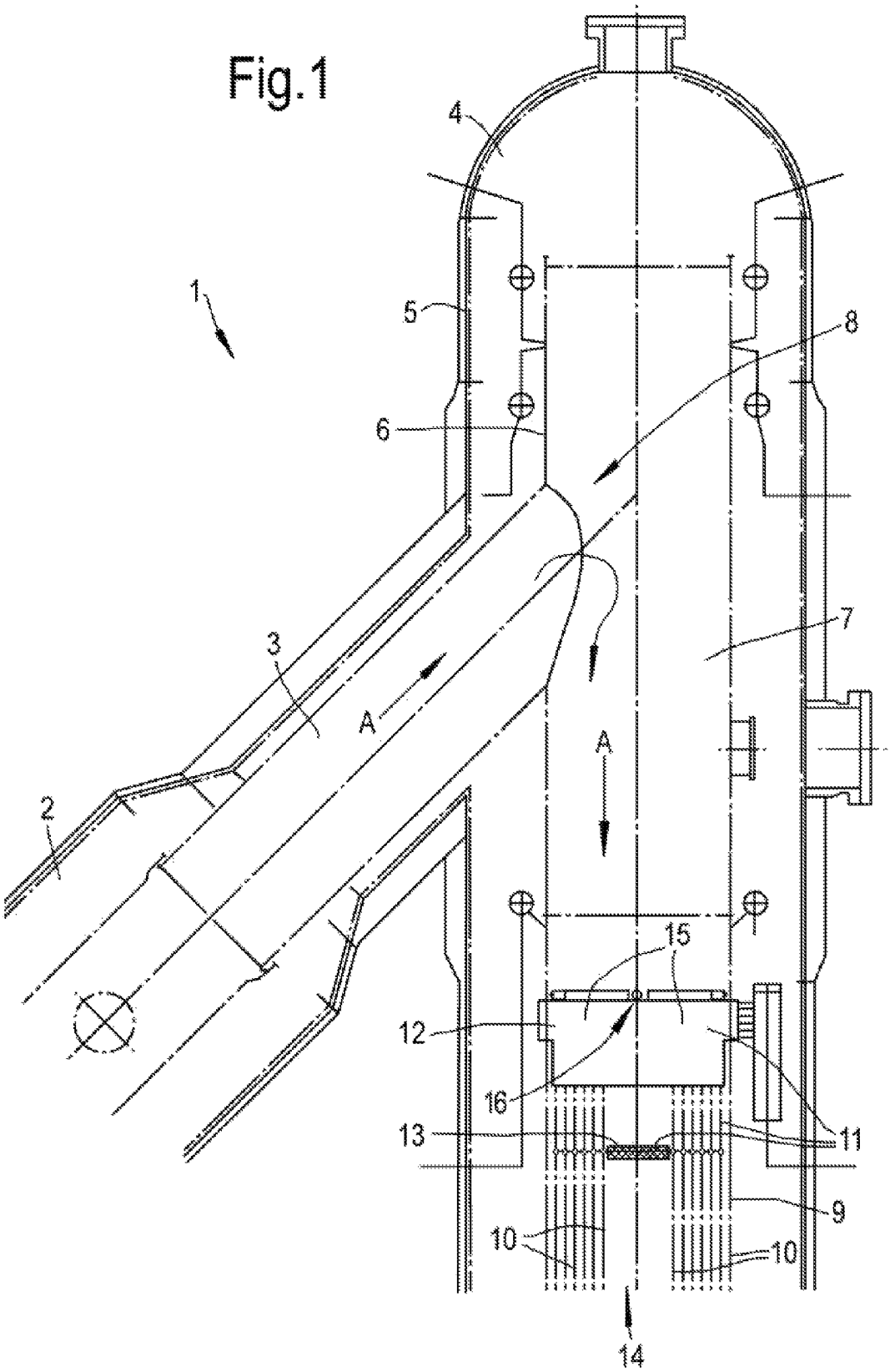

(51) Int. Cl.

| | |
|---|---|
| *F28D 7/16* | (2006.01) |
| *F28D 21/00* | (2006.01) |
| *F28F 9/013* | (2006.01) |
| *F28F 9/02* | (2006.01) |

(56) References Cited

U.S. PATENT DOCUMENTS

| | | | | |
|---|---|---|---|---|
| 4,601,730 | A * | 7/1986 | McGowan | C10J 3/34 48/111 |
| 4,785,877 | A * | 11/1988 | Shen-Tu | C10G 9/002 165/134.1 |
| 4,943,190 | A * | 7/1990 | Dewitz | B01J 8/0015 406/134 |
| 4,950,308 | A * | 8/1990 | Lang | C10J 3/485 48/62 R |
| 5,482,110 | A | 1/1996 | Hartermann et al. | 165/84 |
| 2008/0041572 | A1* | 2/2008 | Wessel et al. | 165/157 |
| 2008/0175769 | A1* | 7/2008 | Goller | F28D 7/1669 422/201 |
| 2009/0130001 | A1* | 5/2009 | Storey | C10J 3/466 422/200 |
| 2010/0216896 | A1* | 8/2010 | Wang | B01J 8/006 518/700 |
| 2010/0263841 | A1* | 10/2010 | Corry | C10J 3/86 165/133 |
| 2011/0010992 | A1* | 1/2011 | Kowoll | B01J 8/003 48/62 R |
| 2011/0049256 | A1* | 3/2011 | Schulze | C10J 3/466 239/1 |
| 2011/0162381 | A1* | 7/2011 | Thacker | C10J 3/845 60/780 |
| 2012/0125567 | A1* | 5/2012 | Von Kossakglowczewski | F28D 7/0041 165/67 |
| 2012/0305847 | A1* | 12/2012 | Von Kossak-Glowczewski | C01J 3/86 252/372 |

FOREIGN PATENT DOCUMENTS

| | | | |
|---|---|---|---|
| GB | 2061758 | 5/1981 | F22B 1/18 |
| WO | WO2010023306 | 3/2010 | C01J 3/82 |

* cited by examiner

GASIFICATION REACTOR WITH A HEAT EXCHANGE UNIT PROVIDED WITH ONE OR MORE FOULING PROTECTION DEVICES

PRIORITY CLAIM

The present application claims priority from PCT/EP2011/064719, filed 26 Aug. 2011, which claims priority from European patent application 10174505.7, filed 30 Aug. 2010, which is incorporated herein by reference.

The present invention relates to a gasification reactor with a heat exchange unit comprising a gas flow channel running from an inlet area to an outlet area and one or more heat exchangers arranged within the gas flow channel, the heat exchangers comprising heat exchange surfaces and associated structures, such as a support structure and deflectors or cover plates to guide the gas flow towards the heat exchange surfaces.

Such gasification reactors can be used for the production of synthetic gas, or syngas. In such a process, carbonaceous feedstock, such as coal, biomass or oil, is partially oxidised in a gasifier unit of the gasification reactor. Subsequently, the syngas flows to the heat exchange unit to be cooled.

U.S. Pat. No. 5,482,110 discloses a heat exchanger for cooling syngas from a partial combustion reactor comprising nested heat exchange surfaces and associated structures in a channel defined by an outer channel wall. The heat exchange surfaces are formed by meandering, helically wound or vertical tubes interconnected to form a gastight wall. The associated structures include a support structure carrying the heat exchange surfaces and a plate blocking the central passage through the central heat exchange surface in order to guide the hot gas as much as possible along the heat exchange surfaces.

When the hot syngas leaves the gasifier unit, it carries fly ash generated as a by-product during the gasification process. Fly ash tends to cause fouling and slag deposits, particularly when the fly ash is still hot and sticky. Fouling and slag deposits on the heat exchange surfaces reduce the cooling efficiency of the heat exchange surfaces. Generally, rappers are used intermittently impacting the heat exchange surfaces to remove foulings and fly ash deposits.

It is an object of the present invention to further prevent efficiency reduction of heat exchangers in the heat exchange section of a gasification reactor by fly ash fouling and slag deposits.

The object of the invention is achieved by providing a gasification reactor with a heat exchange unit comprising heat exchange surfaces and associated structures, wherein the associated structures are provided with one or more fouling protection devices.

Although the contribution of the associated structures to the cooling of the gas is limited, it has surprisingly been found that prevention of slag built-up on these parts does substantially contribute to an overall efficiency of the heat exchanger as a whole.

The one or more fouling protection devices can for instance include one or more soot blowers or blast lances, actively removing slag upon actuation. Good results are obtained with blasters blasting in a radial direction perpendicular to the main gas flow. The blasters can for instance have horizontally directed nozzles in a vertical gas flow channel having an upper inlet and a lower outlet.

Additionally, the one or more fouling protection devices may include flow guiding surfaces, guiding the fly ash bearing gas flow away from the parts to be protected. Such guiding surfaces can for instance be cooled, e.g., they can be formed by one or more interconnected cooling medium conduits, e.g., interconnected parallel or spirally wound conduits or a surface formed by shaped plates with one side forming the guiding surface, optionally having the opposite side thermo-conductively connected to cooling medium channels.

It is noted that WO 2010/023306 discloses a quenching vessel cooling hot syngas by using spray conduits provided with a self cleaning arrangement. No heat exchange surfaces with associated structures are used.

The heat exchangers comprise heat exchange surfaces and associated structures. The heat exchange surfaces can, e.g., be built of vertical, meandering or spirally wound cooling medium conduits, which can for instance be interconnected to form a gastight wall. The heat exchange surfaces can for instance be coaxially nested tubular surfaces.

The associated structures of the heat exchangers can for instance include one or more support structures carrying the one or more heat exchangers. Such a support structure can for instance be located at the inlet side of the heat exchange channel, e.g., with the supported heat exchange surfaces hanging down from the support structure. The support structure can be provided with a fouling protection device, such as one or more blasters directed to blast over an upstream surface of the support structure. Where the gas flow in the heat exchange section of a gasification reactor is typically a vertical downward flow, the upstream surface of the support structure will generally be its top surface. Such a support structure can for instance comprise a plurality of radial arms, e.g., extending from a central point, wherein at least a part of the arms are within the scope of the one or more blasters. The blasters can for instance comprise a blast gas supply line extending over the upstream surface of the arm, one longitudinal side of the blast gas supply line being connected to the arm, while the opposite longitudinal side is provided with at least one nozzle oriented into a direction parallel to the longitudinal direction of the blast gas supply line. Optionally, the blaster can have one or more pairs of oppositely directed nozzles.

The associated structures can also include one or more deflectors to guide the gas flow towards the heat exchange surfaces. For instance, if the heat exchange surfaces comprise a set of coaxially nested tubular surfaces, a cover plate is be used to block the central passage in order to prevent that gas flows at a distance from the heat exchange surface which is too large to cool the passing gas effectively. A suitable fouling protection device for such a structure can for instance be a flow guiding surface covering the upstream surface of the cover plate to guide approaching gas alongside the cover plate. Such a flow guiding surface can for instance be a cone or conical flow guide pointing in upstream direction. Such a conical flow guide can for example be formed by one or more conically spiralling cooling medium conduits operatively connected to a cooling medium supply.

Alternatively, or additionally, the cover plate can be arranged within the blasting scope of one or more blasters. The blaster can for instance have one or more nozzles directed to blast in a direction parallel to the upstream surface of the cover plate. This way the one or more blasters blow over the surface to keep it clean in an effective manner. The one or more blasters can for instance have one or more radially extending nozzles branching off under right angles from a lance or central blast gas supply conduit. The conduit or lance can be positioned under right angles with the upstream surface of the cover plate.

Optionally, the associated structures can also include a tubular inner wall defining the channel around the heat exchange surfaces, the inner wall being surrounded by an outer wall. Such an inner wall can for instance be formed by one or more vertical or spirally wound cooling medium conduits interconnected to form a gastight wall structure or membrane. This tubular inner wall will typically be a cylindrical wall but may also have a different type of tubular configuration. The annular space between the inner wall and the outer wall can be in open connection with the lower end of the flow channel enclosed by the inner wall to more or less equalize the pressure at both sides of the inner wall. That way, the inner wall is mainly subjected to thermal stresses while the outer wall is mainly subjected to stresses caused by the gas pressure. Due to this separation of thermal and pressure induced loads the inner and outer channel walls can be constructed in a more economic way.

Such an inner wall or membrane can be provided with a fouling protection device, preferably at the inlet area of the gas flow channel. For instance, one or more radially extending blast lances can extend through the inner wall having nozzles within the gas flow channel. The nozzles can for instance be interconnected by one or more common blasting gas supply lines positioned between the inner wall and the outer wall. Generally the hot gas inlet is not in line with the centreline of the heat exchange channel. It has been found that it suffices if blast lances are provided only in the cross sectional area below the hot gas inlet, e.g., a 180 degrees semi-circular section of the cross sectional area. For instance two common supply lines extending over 90 degrees can be used to feed blast lances arranged over a semi-circular 180 degrees section of the cross sectional area of the tubular inner wall below the hot gas inlet. Other configurations, for instance spanning 270, 300 or 360 degrees or any other angle, can also be used if so desired. By blasting only the parts particularly exposed to slag formation, blasting gas consumption can be saved.

Typically, the cooling medium used is water. That way, the heat exchanger can be used as a steam generator. The generated steam can be used for other useful purposes, thereby contributing to the economic efficiency of the gasification process as a whole.

The blasting gas can for instance be nitrogen. Alternatively, or additionally, other types of blasting gases can be used, if so desired.

An embodiment of the invention will now be described by way of example in more detail with reference to the accompanying drawings.

Figure 2:
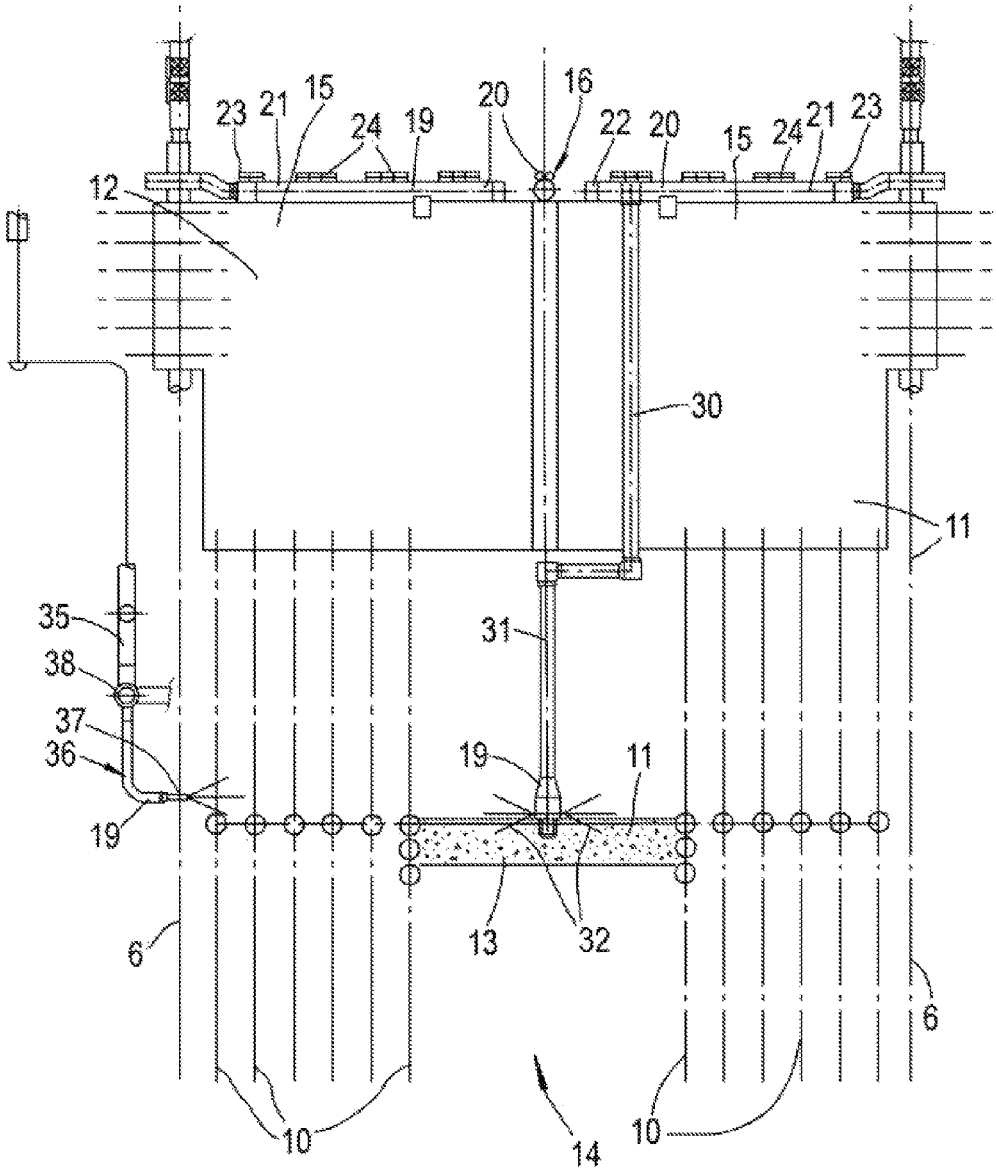
Figure 3A:
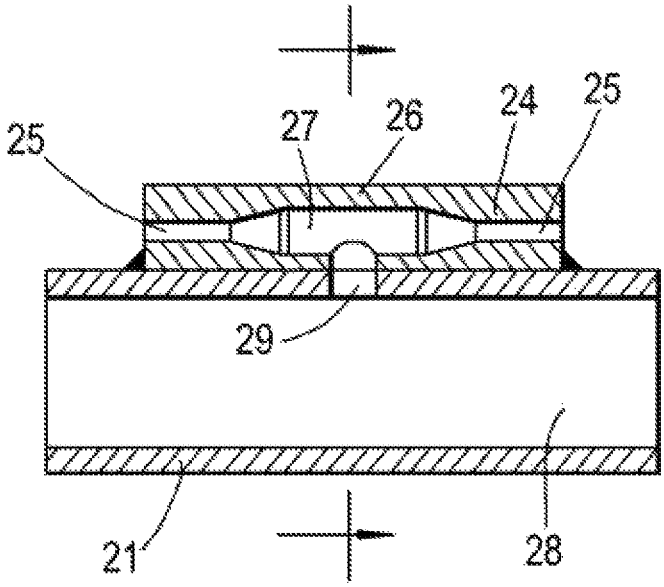
Figure 3B:
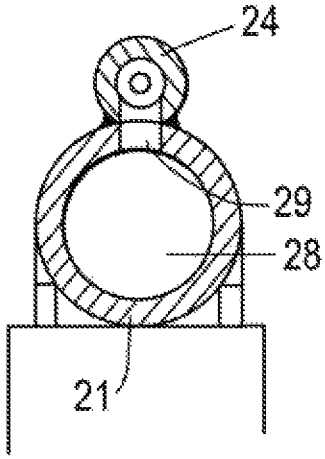
Figure 4:
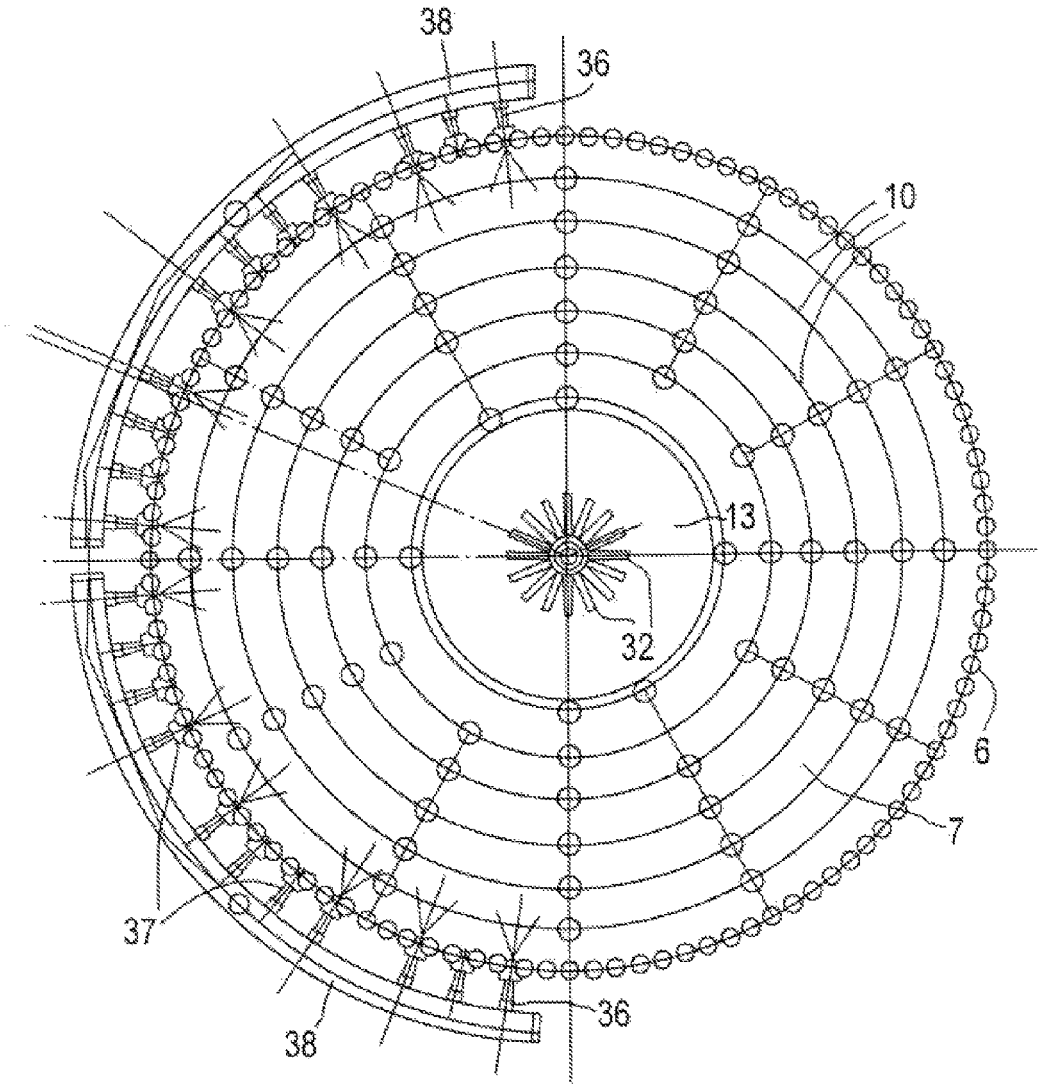
Figure 5:
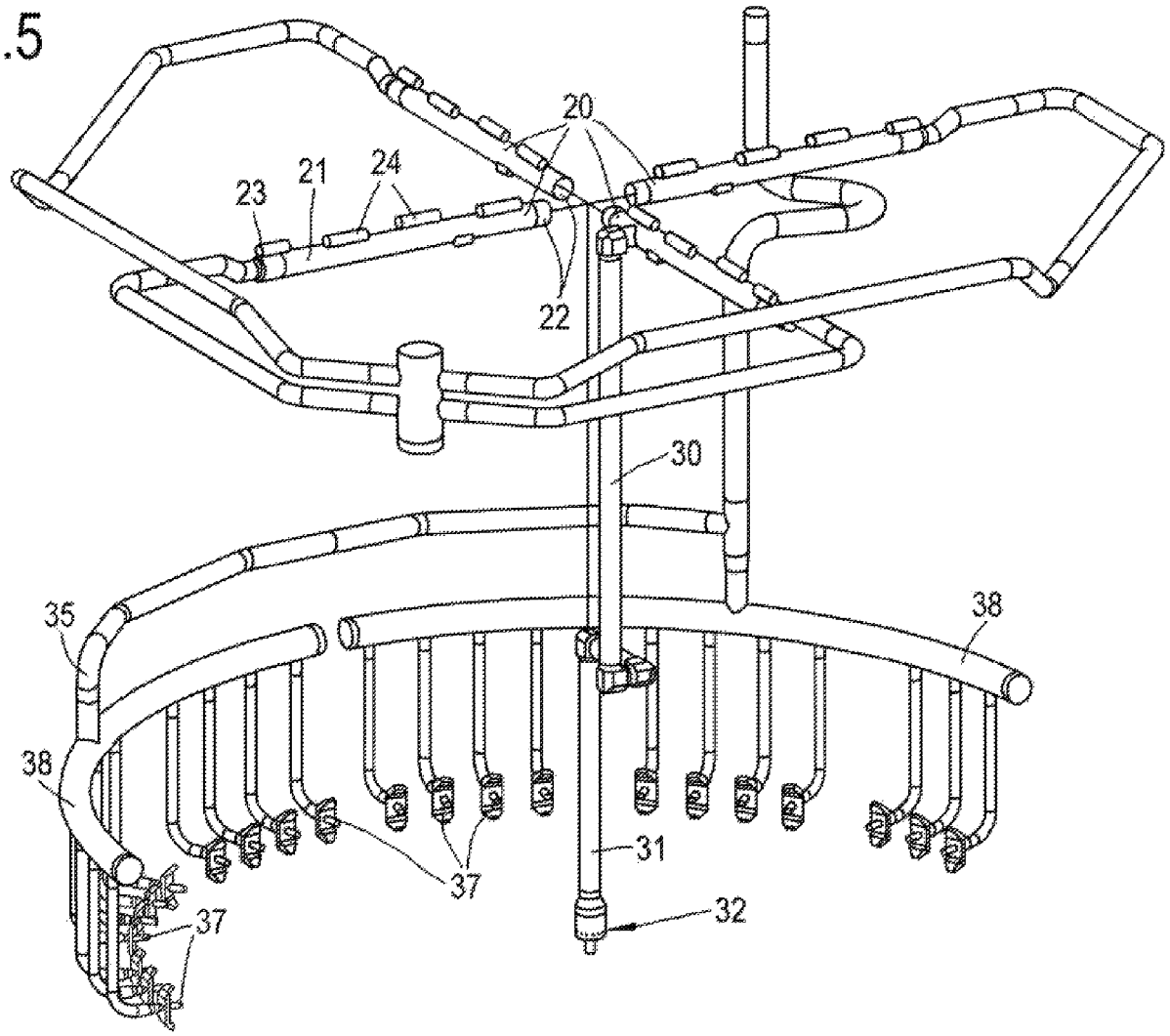
Figure 6:
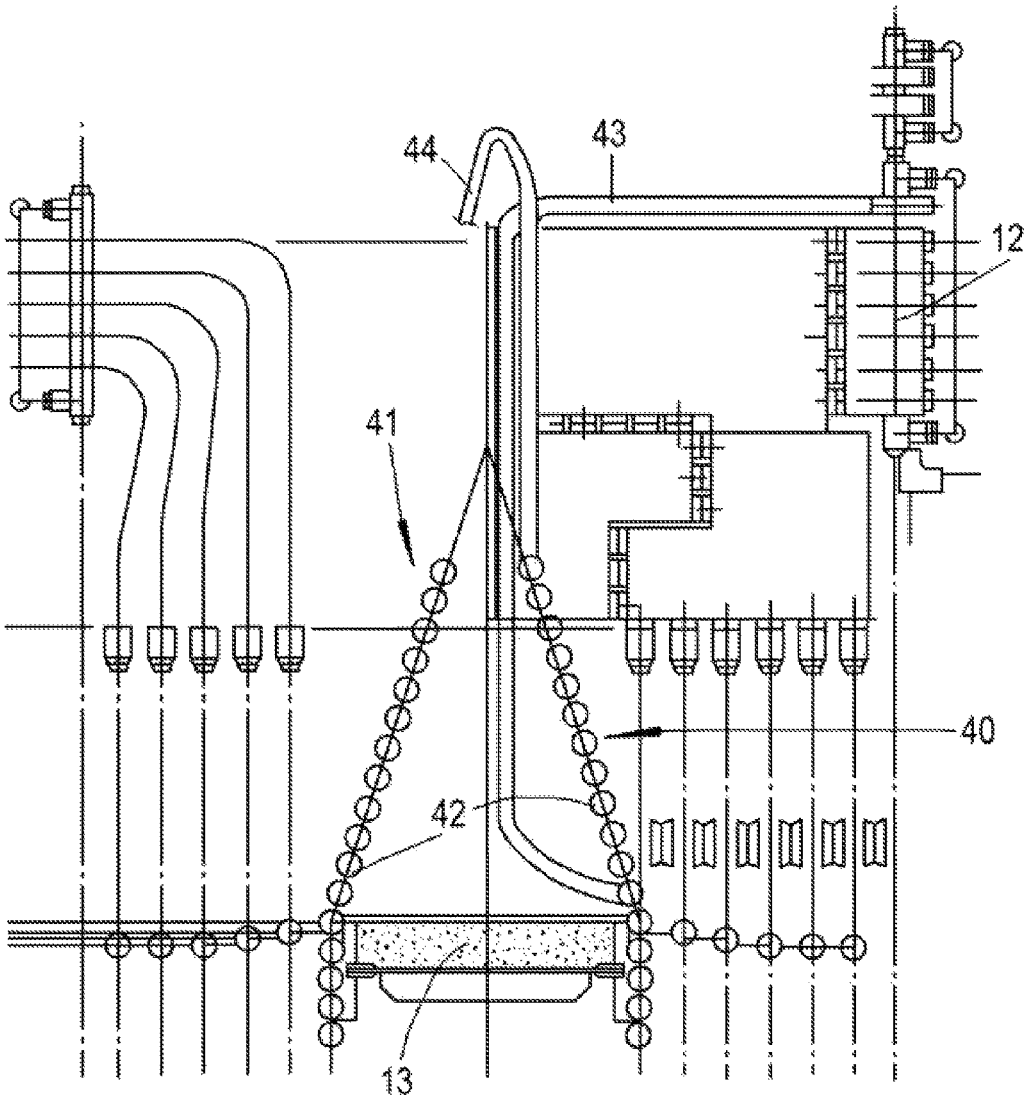
Figure 7:
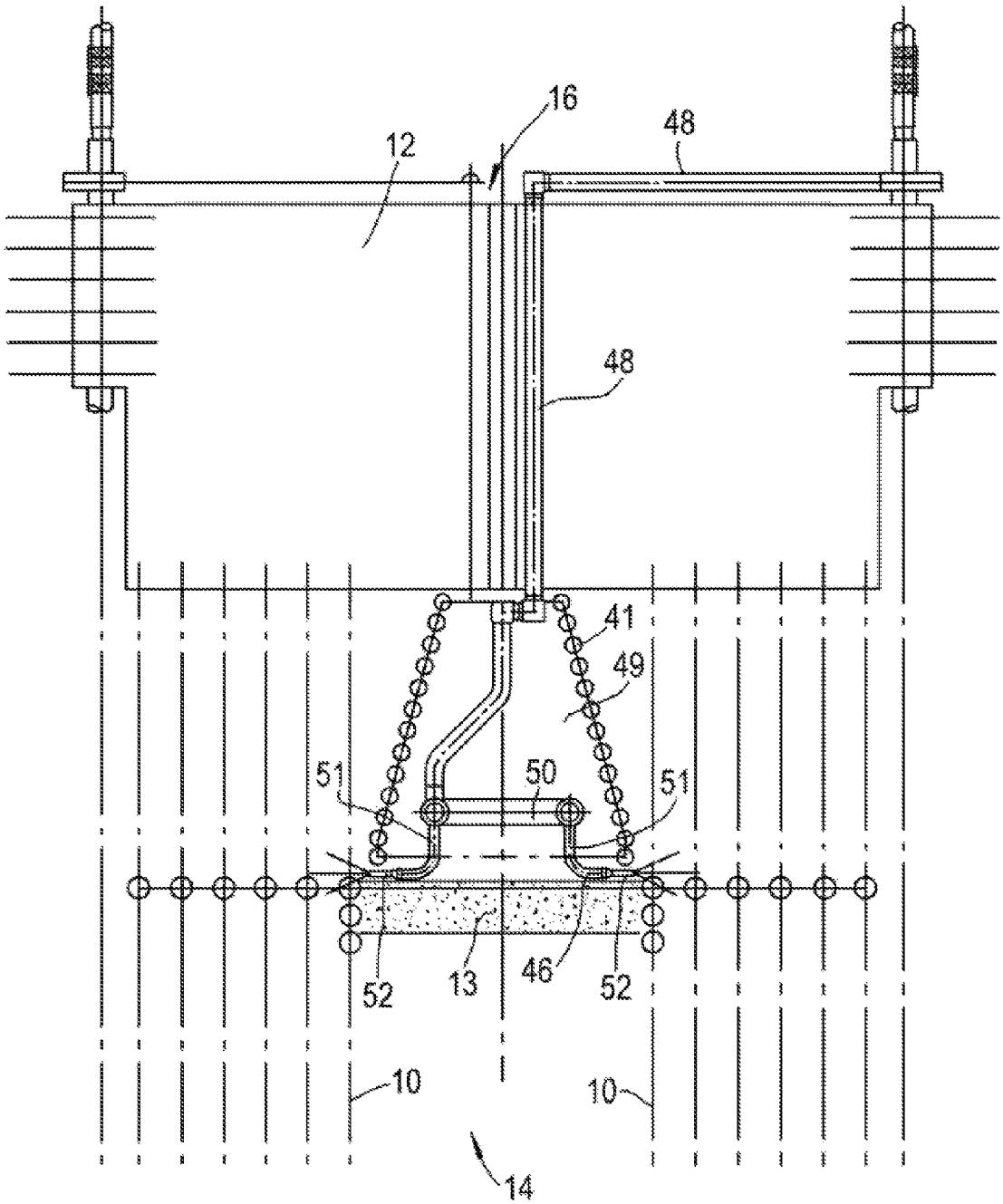

FIG. 1: shows a section of an exemplary embodiment of a gasification reactor according to the invention;

FIG. 2: shows in detail the associate structures of the embodiment of FIG. 1 with a configuration of blasters;

FIG. 3A: shows in longitudinal cross section a nozzle of a blaster of the embodiment of FIG. 1;

FIG. 3B: shows the nozzle of FIG. 3A in cross section;

FIG. 4: shows in plan view a blaster configuration for the inner tubular wall in the embodiment of FIG. 1;

FIG. 5: shows the configuration of blasters in the reactor of FIG. 1 without the rest of the reactor;

FIG. 6: shows schematically a fouling protection device for a flow deflector for an alternative embodiment of a reactor according to the invention;

FIG. 7: shows schematically in cross section a further exemplary embodiment of a heat exchange section of a gasification reactor according to the invention.

FIG. 1 shows in cross section the top section of a gasification reactor 1 for the partial combustion of a carbonaceous feed to form syngas. The reactor 1 comprises a gasifier unit 2 having an upwardly inclined discharge section 3 opening into the top section of a heat exchange unit 4 where the produced syngas is cooled. The heat exchange unit 4 comprises a closed outer wall 5 forming a pressure vessel and encasing a cylindrical inner wall 6, schematically indicated in the drawing by dash dotted lines. The inner wall 6 is formed by parallel vertical cooling liquid conduits interconnected to form a gastight tubular membrane confining a gas flow channel 7. The discharge 3 of the gasifier unit 2 opens into an inlet area 8 of the channel 7. Syngas flows in the direction of arrows A, upwardly from discharge 3 of the gasifier unit 2 into the heat exchange unit 4 through the channel 7 to a lower outlet area (not shown).

A heat exchanger 9 is arranged within the channel 7. The heat exchanger 9 comprises a set of, e.g., six nested cylindrical heat exchange surfaces 10, which are schematically represented in the drawing by dash dotted lines. In alternative embodiments, the number of heat exchange surfaces can be less than six or more than six, if so desired. The heat exchange surfaces 10 are formed by spirally wound cooling medium conduits interconnected to form a gastight structure. The nested heat exchange surfaces 10 are coaxial with the inner wall 6 and the outer wall 5. The heat exchanger 9 further comprises associated structures 11, including a support structure 12 and a cover plate 13 blocking the central passage 14 through the inner heat exchange surface 10. The heat exchange surfaces 10 hang down from the support structure 12, which is in turn supported by the inner wall 6.

The associated structures 11, including the support structure 12 and the cover plate 13, are shown in more detail in FIG. 2. The support structure 12 is a symmetrical support cross having four radial arms 15 extending from a central point 16.

The associated structures 6, 12, 13 are provided with fouling protection devices 19. These include blasters 20 on the top edge of each of the arms 15 of the support structure 12. Each blaster 20 comprises a conduit 21 with a closed end 22 and with its lower side connected to the corresponding arm 15, while the opposite top side carries nozzles 23, 24 oriented in a direction parallel to the conduit 21. Nozzles 23 closest to the inner wall 6 are nozzles with a single orifice directed away from the inner wall 6. The other nozzles 24 have two oppositely directed orifices 25, as shown in more detail in FIGS. 3A and 3B. The nozzles 24 have a cylindrical body 26 with a central bore 27 narrowing at its outer ends as a venturi reduction forming the orifices 25. The central bore 27 is in open connection with the inner space 28 of the conduit 21 via a channel 29.

As shown in FIG. 2, a nitrogen supply line 30 branches off from the conduit 20 of the blaster 21 on one of the arms 15 of the support structure 12. This supply line 30 leads to a blast lance 31 centrally disposed within the central passage 14 through the inner heat exchange surface 10. The blast lance 31 extends to the cover plate 13 where a plurality of radially directed nozzles 32 branches off from the lance 31, as shown in plan view in FIG. 4. This way, the nozzles 32 can blast the cover plate 13 free from slag deposits.

A further blast gas supply line 35 leads to radially extending horizontal blast lances 36 crossing the inner wall 6, as shown in plan view in FIG. 4. The blast lances 36 have nozzles 37 within the gas flow channel 7. The blast lances 36 are interconnected by two blasting gas supply lines 38 positioned between the inner wall 6 and the outer wall 5. The two supply lines 38 are 90 degrees circle segments and feed blast lances arranged over a semi-circular 180 degrees section of the cross sectional area of the gas flow channel 7. This way, only the half of the gas flow channel 7 below the hot gas inlet area 8 (see FIG. 1), where most fouling takes place, is blasted. By blasting only the parts particularly exposed to slag formation nitrogen consumption can be saved.

FIG. 5 shows a perspective view of the complete configuration of all blasters, without showing the rest of the heat exchange area of the gasification reactor 1.

FIG. 6 shows an alternative fouling protection device 40 for the cover plate 13 of a heat exchange unit of a gasification reactor according to the invention. The fouling protection device 40 comprises a conical guiding surface 41 covering the cover plate 13 with its top pointing away from the cover plate 13 in an upstream direction. The conical guiding surface 41 is made of spirally wound cooling medium conduits 42 operatively connected to a cooling medium supply line 43 and a cooling medium discharge line 44. The conical surface 41 guides the hot gas flow around the cover plate 13 to the flow path along the heat exchange surfaces 10 to prevent or at least reduce slag deposition on the cover plate 13.

FIG. 7 shows an alternative embodiment, similar to the embodiment shown in FIG. 6. Same reference numbers are used for the same parts. Besides the guiding surface 41 it comprises a further fouling protection device 46 comprising a blast gas supply line 48 leading to a point close to the central point 16 of the support cross 12, where it turns downwardly into the space 49 enclosed by the conical surface 41 where it opens into a ring line 50. A plurality of blasters 51 branch off from the ring line 50 and turn from a vertical to a radial direction. The ends of the blasters 51 comprise nozzles 52 horizontally directed towards the inner heat exchange surface 10.

What is claimed is:

1. A gasification reactor with a heat exchange unit, the heat exchange unit comprising:

a gas flow channel;

one or more heat exchangers arranged within the gas flow channel, the one or more heat exchangers comprising:

a set of coaxially nested tubular heat exchange surfaces having a central passage;

one or more support structures carrying the set of heat exchange surfaces, at least one support structure of the one or more support structures being located at the inlet side of the heat exchanger;

one or more blasters directed to blast over an upstream surface of the at least one support structure being located at the inlet side of the heat exchanger; and a cover plate blocking the central passage of the set of tubular heat exchange surfaces, an upstream surface of the cover plate being provided with a blast lance having one or more nozzles directed to blast in a direction parallel to the upstream surface.

2. The gasification reactor according to claim 1 wherein the support structure comprises a plurality of radial arms extending from a central point, wherein at least part of the arms are within the scope of the one or more blasters.

3. The gasification reactor according to claim 2 wherein one or more of the arms of the support structure carries a blaster comprising a blast gas supply line extending over the upstream surface of the arm, one longitudinal side of the blast gas supply line being connected to the arm while the opposite longitudinal side is provided with a plurality of nozzles directed in a direction parallel to the arm.

4. The gasification reactor according to claim 3 wherein the nozzles on the arm are at least partly arranged in pairs of oppositely directed nozzles.

5. The gasification reactor according to claim 1 wherein the nozzles branch off under right angles from a central supply conduit.

6. The gasification reactor according to claim 1 wherein the cover plate blocks a central passage through a tubular heat exchange surface, provided with a conical flow guide pointing in upstream direction covering the upstream surface of the cover plate.

7. The gasification reactor according to claim 6 wherein the conical flow guide is formed by one or more conically spiraling cooling medium conduits.

8. The gasification reactor according to claim 1, comprising a tubular inner wall defining the gas flow channel, coaxially surrounded by an outer wall, the inner wall being formed by cooling medium conduits interconnected to form a gastight membrane, wherein one or more radially extending blast lances extend through the membrane having nozzles within the gas flow channel.

9. The gasification reactor according to claim 8 wherein one or more of the radially extending blast lances are interconnected by one or more common blast gas supply lines between the inner wall and the outer wall.

10. The gasification reactor according to claim 9 wherein a hot gas discharge of a gasifier unit opens eccentrically into the inlet area of the gas flow channel and the one or more radially extending blast lances crossing the inner wall are located in an area below the hot gas discharge.

11. The gasification reactor according to claim 10 wherein the area occupied by the radially extending blast lances spans a semi-circular section of the gas flow channel cross sectional area.

12. The gasification reactor according to claim 1 wherein the gas flow channel runs vertically downwards.

13. The gasification reactor according to claim 1, wherein the supported one or more heat exchange surfaces hangs down from the at least one support structure located at the inlet side of the heat exchanger.

* * * * *